US006698401B2

(12) United States Patent
Suzuki et al.

(10) Patent No.: US 6,698,401 B2
(45) Date of Patent: Mar. 2, 2004

(54) FUEL SUPPLY CONTROL SYSTEM FOR AN OUTBOARD MOTOR

(75) Inventors: Masaru Suzuki, Shizuoka (JP); Hitoshi Watanabe, Shizuoka (JP); Yoshibumi Iwata, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/001,259

(22) Filed: Nov. 15, 2001

(65) Prior Publication Data

US 2002/0083923 A1 Jul. 4, 2002

Related U.S. Application Data

(60) Provisional application No. 60/322,352, filed on Sep. 13, 2001.

(30) Foreign Application Priority Data

Nov. 15, 2000 (JP) ..... 2000-348863

(51) Int. Cl.[7] ..... F02M 33/04
(52) U.S. Cl. ..... 123/516; 123/497
(58) Field of Search ..... 123/497, 516, 123/458

(56) References Cited

U.S. PATENT DOCUMENTS

| | | | | |
|---|---|---|---|---|
| 4,430,980 A | | 2/1984 | Pidgeon | |
| 4,577,604 A | | 3/1986 | Hara et al. | |
| 4,800,859 A | | 1/1989 | Sagisaka et al. | |
| 4,867,120 A | | 9/1989 | Boda et al. | |
| 4,884,545 A | | 12/1989 | Mathis | |
| 4,919,102 A | | 4/1990 | Iwabuchi | |
| 4,920,942 A | | 5/1990 | Fujimori et al. | |
| 4,926,829 A | | 5/1990 | Tuckey | |
| 5,085,193 A | | 2/1992 | Morikawa | |
| 5,103,793 A | | 4/1992 | Riese et al. | |
| 5,309,885 A | | 5/1994 | Rawlings et al. | |
| 5,375,578 A | | 12/1994 | Kato et al. | |
| 5,379,741 A | * | 1/1995 | Matysiewica | 123/497 |
| 5,389,245 A | | 2/1995 | Jaeger et al. | |
| 5,411,002 A | | 5/1995 | Smitley | |
| 5,477,833 A | | 12/1995 | Leighton | |
| 5,505,180 A | * | 4/1996 | Otterman et al. | 123/497 |
| 5,542,395 A | * | 8/1996 | Tuckey | 123/497 |
| 5,579,738 A | * | 12/1996 | Frischmuth et al. | 123/497 |
| 5,819,709 A | * | 10/1998 | Holmes et al. | 123/497 |
| 5,819,711 A | | 10/1998 | Motose | |
| 5,848,583 A | * | 12/1998 | Smith et al. | 123/497 |
| 5,873,347 A | | 2/1999 | Kato et al. | |
| 5,913,294 A | | 6/1999 | Takahashi et al. | |
| 5,915,363 A | | 6/1999 | Iwata et al. | |
| 6,006,705 A | | 12/1999 | Kato et al. | |
| 6,030,261 A | | 2/2000 | Motose | |
| 6,065,445 A | | 5/2000 | Motose et al. | |
| 6,223,731 B1 | * | 5/2001 | Yoshiume et al. | 123/497 |
| 6,269,799 B1 | | 8/2001 | Watanabe et al. | |
| 6,314,947 B1 | * | 11/2001 | Roche | 123/497 |

FOREIGN PATENT DOCUMENTS

JP 08-246974 9/1996

* cited by examiner

*Primary Examiner*—Thomas N. Moulis
(74) *Attorney, Agent, or Firm*—Knobbe, Martens, Olson & Bear, LLP

(57) ABSTRACT

A fuel supply system for an outboard motor regulates the fuel pressure to a vapor separator in a fuel injection system by using a pressure relief valve that returns excess fuel to the intake of the fuel pump. In order to permit excess fuel flow without substantial excess at low speeds, the fuel pump speed is regulated depending upon engine speed, fuel temperature, and fuel pressure.

9 Claims, 3 Drawing Sheets

FUEL SUPPLY CONTROL SYSTEM FOR AN OUTBOARD MOTOR

PRIORITY INFORMATION

This application is based on and claims priority to Japanese Patent Application No. 2000-348863, filed Nov. 15, 2000 and to the Provisional Application No. 60/322,352, filed Sep. 13, 2001, (Attorney Docket No. FS.17314US0PR) the entire contents of which is hereby expressly incorporated by reference.

FIELD OF THE INVENTION

The present invention relates generally to a fuel supply control arrangement for an engine, and more particularly to an improved fuel supply control arrangement for a split-bank, multicylinder engine.

DESCRIPTION OF THE RELATED ART

It has been the practice in conjunction with fuel injection systems for engines to provide a pressure relief system so that the fuel pressure at the injector is maintained stable. This is important to ensure that the injection strategy results in the injection of the appropriate amount of fuel for proper engine operation. Normally, the fuel pressure is regulated by a pressure relief valve that returns excess fuel supplied to the injectors, their associated fuel rail, or both back to some place in the supply circuit. The excess fuel may be returned directly to the fuel tank or to other locations in the fuel supply system upstream of the injector.

In order to have excess fuel for pressure regulation, the amount of fuel supplied to the injectors must be somewhat greater than the total amount of fuel which will be consumed by the engine under all running conditions for which pressure regulation is desired. This supply of excess fuel has certain advantages.

If excess fuel is supplied, then it is possible to use the fuel flow to cool certain components of the engine, particularly the fuel injector. Furthermore, by continuously recycling a portion of the fuel, the fuel vapor separator can do a better job of separating vapors from the fuel to ensure that the fuel supplied to the engine is vapor free. Vapors in the fuel will result in the injection of less fuel than desired if the vapors are not separated before delivery to the injectors.

It is also known that the fuel pump must supply adequate amounts of fuel for all operating conditions, particularly under high speed and high load conditions. Thus, if a constantly operated pump is employed, large excesses of fuel will be pumped under low speed and low load conditions. The pumping of large excesses of fuel has certain disadvantages.

Although circulating excess fuel has the advantage of providing cooling for the fuel, the circulation of to much fuel can heat the fuel such that the desired cooling effect is not achieved. Also, if there are gross differences in the amount of fuel supplied, then the pressure regulator may not be capable of providing the desired regulation at all engine speeds and load ranges.

SUMMARY OF THE INVENTION

A principal object of the embodiments of the present invention is to provide an improved fuel supply system for an engine.

A further object of the embodiments of the present invention is to provide an improved fuel supply system for an internal combustion engine that will provide appropriate slight excesses of fuel supply under all running conditions.

The embodiments of the present invention are adapted to be embodied in a fuel supply system for an engine. The fuel supply system includes a tank that stores fuel, a fuel injector that injects the fuel to the engine, and an electrically driven pump that pumps fuel from the tank to the fuel injector through a conduit. A bypass system is provided for returning excess fuel pumped by the fuel pump to the injectors back to a supply side of the system. Means are provided for monitoring engine conditions to detect the amount of fuel being consumed. When the fuel consumption is determined to be lower than a predetermined value, then the electrically driven pump is driven at a lower rate.

One aspect of the present invention is a fuel supply system for an internal combustion engine. The fuel supply system provides fuel to the internal combustion engine. The fuel supply system comprises at least one fuel pump driven by an electric motor, and an electronic control unit that controls the electric motor to control the fuel flow through the fuel pump in response to engine speed, fuel temperature and fuel pressure.

Preferably, the fuel pump is a low pressure pump supplying the fuel to a vapor separator, wherein the speed of the low pressure fuel pump is controlled by the electronic control unit dependent on engine speed, fuel pressure, and fuel temperature. The engine speed is determined using an engine speed sensor, the fuel temperature is determined using a fuel temperature sensor, and the fuel pressure is determined using a fuel pressure sensor. A fuel pressure relief valve relieves fuel pressure from the pressure side of the low pressure fuel pump and delivers the fuel to the scavenge side of the low pressure fuel pump. Preferably, the fuel pressure sensors and the fuel temperature sensor are located on the pressure side of the low pressure fuel pump and before the pressure relief valve circuit.

Within the internal combustion engine, a plurality of fuel injectors are in communication with a high pressure fuel pump being supplied by the vapor separator. The fuel injectors deliver vaporless fuel to at least one intake port or directly into at least one combustion chamber.

The internal combustion engine is advantageously a marine engine. For example, the marine engine provides power to a watercraft. In preferred embodiments, the marine engine is an outboard motor.

BRIEF DESCRIPTION OF THE DRAWINGS

The foregoing features, aspects, and advantages of the present invention will now be described with reference to the drawings of a preferred embodiment that is intended to illustrate and not to limit the invention. The drawings comprise two figures in which.

DETAILED DESCRIPTION OF THE PREFERRED EMBODIMENT

Figure 1:
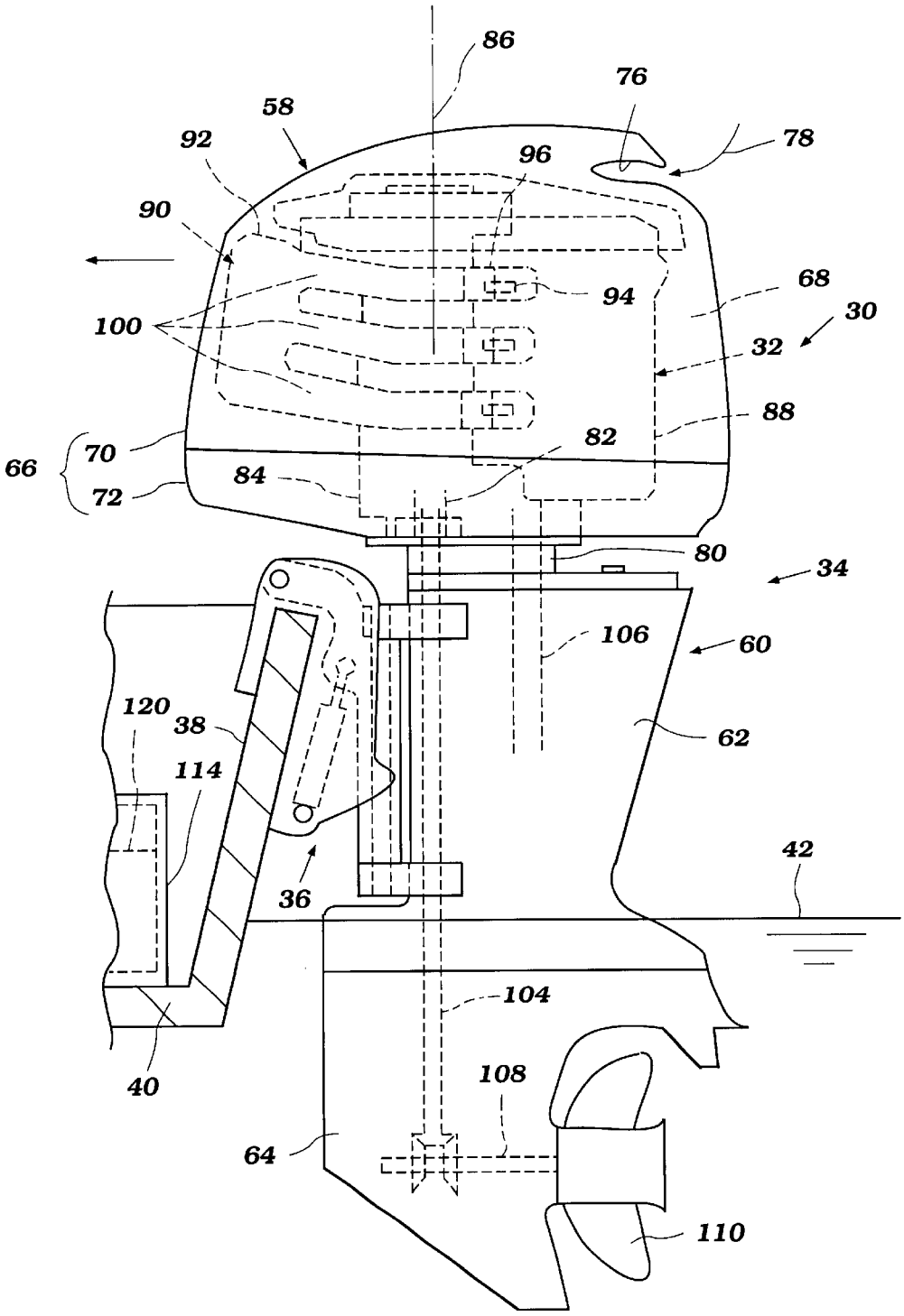
FIG. 1 is a side elevational view of an outboard motor configured in accordance with a preferred embodiment of the present invention, with an associated watercraft partially shown in section.

FIG. 1 illustrates an overall construction of an outboard motor 30 that employs an internal combustion engine 32 configured in accordance with certain features, aspects and advantages of the present invention. The engine 32 has particular utility in the context of a marine drive, such as, for example the outboard motor 30, and thus is described in the context of an outboard motor. The engine 32, however, can be used with other types of marine drives (i.e., inboard motors, inboard/outboard motors, etc.) and also with certain land vehicles, which include lawnmowers, motorcycles, go carts, all terrain vehicles, and the like. Furthermore, the engine 32 can be used as a stationary engine for some applications that will become apparent to those of ordinary skill in the art.

In the illustrated arrangement, the outboard motor 30 generally comprises a drive unit 34 and a bracket assembly 36. The bracket assembly 36 supports the drive unit 34 on a transom 38 of an associated watercraft 40 and places a marine propulsion device (e.g., a propeller) in a submerged position with the watercraft 40 resting relative to a surface 42 of a body of water.

The illustrated drive unit 34 comprises a power head 58 and a housing unit 60, which includes a driveshaft housing 62 and a lower unit 64. The power head 58 is disposed atop the housing unit 60 and includes an internal combustion engine 32 that is positioned within a protective cowling assembly 66, which preferably is made of plastic. In most arrangements, the protective cowling assembly 66 defines a generally closed cavity 68 in which the engine 32 is disposed.

A top cowling member 70 preferably has a rear intake opening 76 defined through an upper rear portion. A rear intake member with one or more air ducts is unitarily formed with or is affixed to the top cowling member 70. The rear intake member, together with the upper rear portion of the top cowling member 70, generally defines a rear air intake space. Ambient air is drawn into the closed cavity 68 via the rear intake opening 76 and the air ducts of the rear intake member as indicated by an arrow 78 of FIG. 1.

A bottom cowling member 72 has an opening through which an upper portion of an exhaust guide member or support member 80 extends. The exhaust guide member 80 preferably is made of aluminum alloy and is affixed atop the driveshaft housing 62. The bottom cowling member 72 and the exhaust guide member 80 together generally form a tray. The engine 32 is placed onto this tray and can be affixed to the exhaust guide member 80. The exhaust guide member 80 also defines an exhaust discharge passage through which burnt charges (e.g., exhaust gases) from the engine 32 pass.

The engine 32 in the illustrated embodiment operates on a four-cycle combustion principle. This type of engine, however, merely exemplifies one type of engine on which various aspects and features of the present invention can be suitably used. Preferably, the engine has at least two cylinder banks, which extend separately of each other. For instance, an engine having an opposing cylinder arrangement can use certain features of the present invention. Nevertheless, engines having other numbers of cylinders, having other cylinder arrangements (in-line, opposing, etc.), and operating on other combustion principles (e.g., crankcase compression two-stroke or rotary) also can employ various features, aspects and advantages of the present invention. In addition, the engine can be formed with separate cylinder bodies rather than a number of cylinder bores formed in a cylinder block. Regardless of the particular construction, the engine preferably comprises an engine body that includes at least one cylinder bore.

A crankshaft 82 extends generally vertically through a cylinder block 84 and can be journaled for rotation about a rotational axis 86 by several bearing blocks. Connecting rods (not shown) couple the crankshaft 82 with the respective pistons (not shown) in any suitable manner. Thus, the reciprocal movement of the pistons (not shown) rotates the crankshaft 82.

Watercraft engines typically incorporate electrical generators. The crankshaft 82 rotates a magneto generator 87 (FIG. 2) and the electricity produced is used to recharge a battery 89 or to directly power the ignition system used to ignite the fuel/air mixture inside the cylinder of the engine 32. The magneto generator includes a pulsar coil 91 to trigger an ignition device (not shown) for igniting the air/fuel mixture.

As shown in FIG. 1, the cylinder block 84 is preferably located at the forwardmost position of the engine 32. A cylinder head assembly 88 is disposed rearward from the cylinder block 84. Generally, the cylinder block 84 (or individual cylinder bodies) and the cylinder head assembly 88 together define the engine 32.

The engine 32 preferably has an intake system 90 comprising an intake silencer 92 and indirect, port or intake passage fuel injection. The fuel injection system preferably comprises six fuel injectors 94 with one fuel injector allotted for each one of the respective cylinders. The fuel injectors 94 preferably are mounted on throttle bodies 96. Fuel rails 98 also define portions of the fuel conduits to deliver fuel to the injectors 94.

Figure 2:
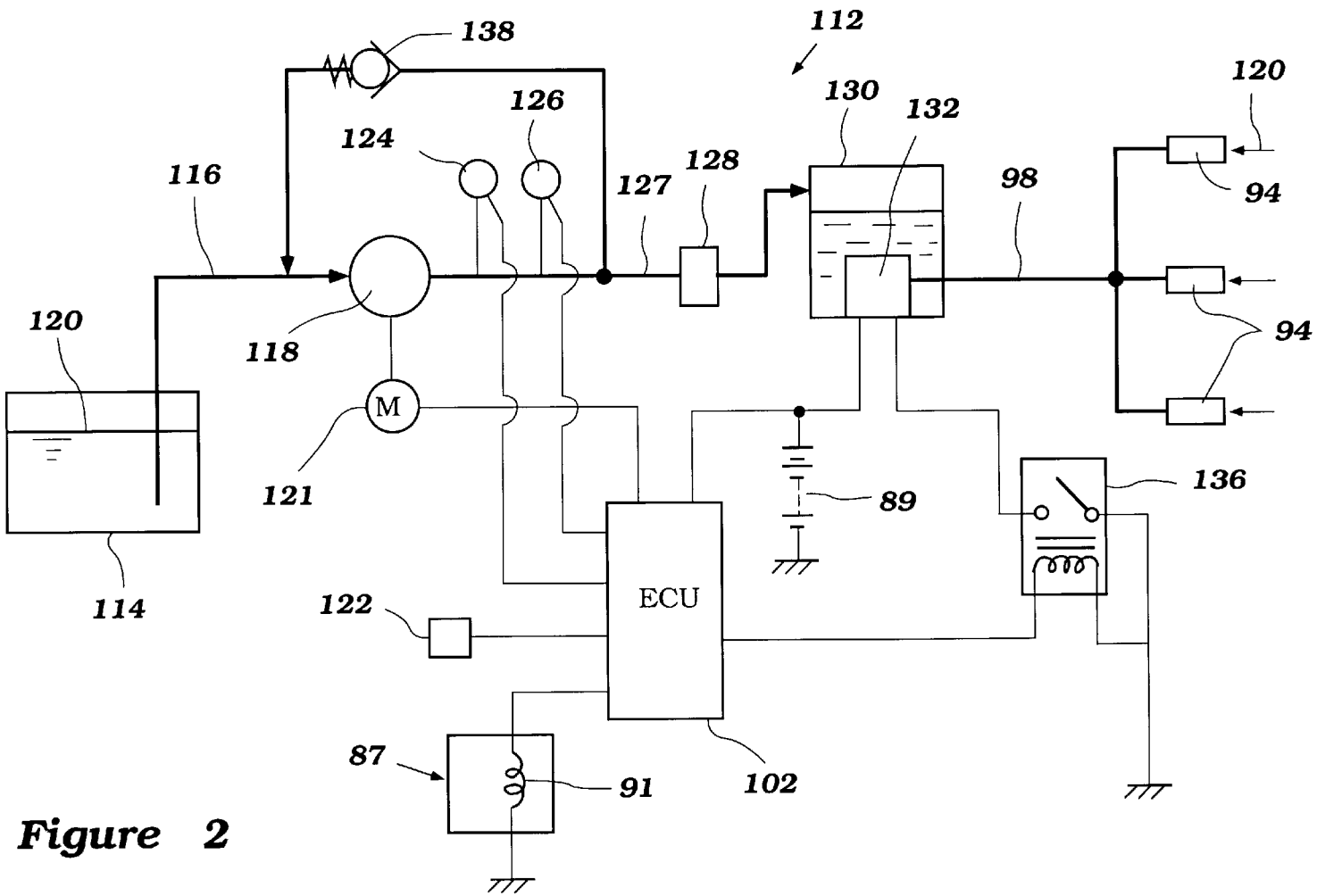
FIG. 2 is a schematic drawing illustrating the fuel supply control system.

Each fuel injector 94 preferably has an injection nozzle directed downstream within associated intake passages 100, which are downstream of the throttle bodies 96. The fuel injectors 94 spray fuel into the intake passages 100 under control of an electronic control unit (ECU) 102 (FIG. 2). The ECU 102 controls both the initiation timing and the duration of the fuel injection cycle of the fuel injectors 94 so that the nozzles spray a proper amount of fuel each combustion cycle.

The engine 32 typically includes a cooling system, a lubrication system and other systems, mechanisms or devices other than the systems described above.

As shown in FIG. 1, the driveshaft housing 62 depends from the power head 58 to support a driveshaft 104 which is coupled with the crankshaft 82 and which extends generally vertically through the driveshaft housing 62. The driveshaft 104 is journaled for rotation and is driven by the crankshaft 82. The driveshaft housing 62 defines an internal section 106 of the exhaust system that leads the majority of exhaust gases to the lower unit 64. The internal section 106 includes an idle discharge portion that is branched off from a main portion of the internal section 106 to discharge idle exhaust gases directly out to the atmosphere through a discharge port that is formed on a rear surface of the driveshaft housing 62 in idle speed of the engine 32.

The lower unit 64 depends from the driveshaft housing 62 and supports a propulsion shaft 108 that is driven by the driveshaft 104. The propulsion shaft 108 extends generally horizontally through the lower unit 64 and is journaled for rotation. A propulsion device is attached to the propulsion shaft 108. In the illustrated arrangement, the propulsion device is a propeller 110 that is affixed to an outer end of the propulsion shaft 108. The propulsion device, however, can take the form of a dual counter-rotating system, a hydrodynamic jet, or any of a number of other suitable propulsion devices.

As shown in FIG. 2, the engine 32 includes a fuel supply system 112. The fuel supply system 112 includes a remotely positioned fuel tank 114 that is disposed in the hull of a watercraft 40 (FIG. 1). A fuel scavenge conduit 116 extends from the fuel tank 114 to the scavenge side of a low pressure fuel pump 118. By positioning the main fuel tank 114 remotely, the fuel tank can have a much larger volume and can store more fuel 120 than if the fuel tank were located on the motor 30.

A motor 121 drives the low pressure fuel pump 118. In accordance with the invention, the motor 121 is controlled by the ECU 102 so as to regulate the speed of the low pressure fuel pump 118. The ECU 102 regulates the speed of the low pressure pump 118 in response to parameters provided by various sensors including an engine speed sensor 122, a fuel pressure sensor 124, and a fuel temperature sensor 126. The low pressure fuel pump 118 pumps the fuel 120 through a pressured fuel conduit 127 through a fuel filter 128 and then to a fuel vapor separator 130. An in-tank, high-pressure fuel pump 132 is mounted within the vapor separator 130. The high pressure fuel pump 132 picks up the fuel 120 and delivers the fuel to the various fuel injectors 94. The high-pressure fuel pump 132 and the ECU 102 are powered through the battery 89 as seen in the schematic of FIG. 2. The high pressure fuel pump 132 is controlled by the ECU 102 through a relay 136.

To assure that the fuel in the pressure fuel conduit 127 and the fuel supplied to the vapor separator 130 are at a constant pressure, a pressure regulator valve 138 is mounted between the pressure fuel conduit 127 and the scavenge fuel conduit 116. The pressure regulator valve 138 regulates pressure by dumping excess fuel back to the scavenge fuel conduit 116. In a preferred arrangement, the fuel is returned directly to the low pressure fuel pump 118 through the scavenge fuel conduit 116.

As noted above, it is desirable to provide some excess fuel flow under substantially all running conditions. However, this means that the low pressure fuel pump 118 delivers substantially more fuel than is required for operating at low speeds if the fuel pump 118 is capable of supplying excess fuel at high speeds. Therefore, the embodiments of the present invention provide an arrangement for operating the low pressure fuel pump 118 at varying speeds through multiple stages or steps.

In the illustrated embodiment, the varying speed control for operating the low-pressure fuel pump 118 operates in response to engine speed, fuel temperature, and fuel pressure. Hence, the ECU 102, specifically the control phase thereof, receives signals from the engine speed sensor 122, the fuel temperature sensor 126, and the fuel pressure sensor 124.

Figure 3:
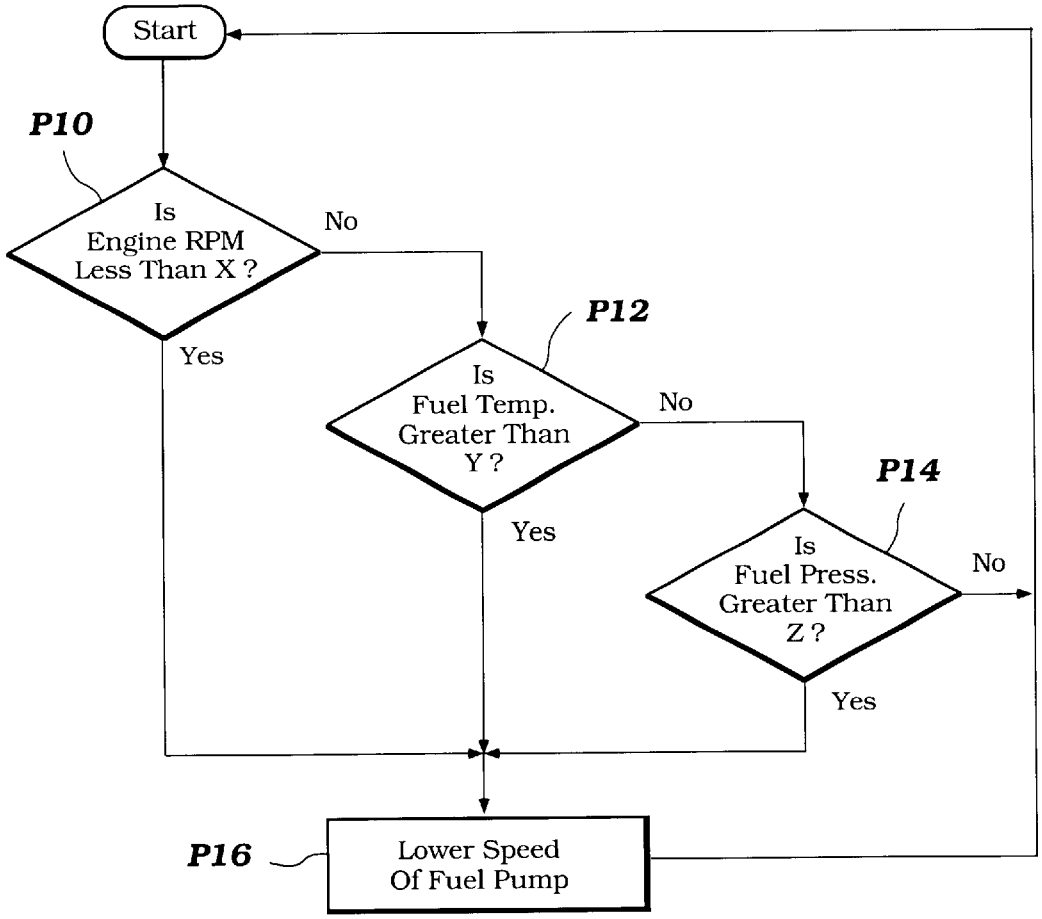
FIG. 3 is a flow chart showing a control routine arranged and configured in accordance with certain features, aspects, and advantages of the present invention.

As shown in FIG. 3, a flowchart showing an exemplary control routine for the ECU 102 is arranged and configured in accordance with certain features, aspects, and advantages of the present invention. The control routine begins and moves to a first decision block P10 in which the engine speed is compared to a predetermined engine speed "X" (e.g., X can be about 1000 RPM some applications).

If the speed is greater than "X", the routine moves to operation block P16 where the fuel pump speed is decreased. After the fuel pump speed is reduced, the routine repeats.

Returning to decision block P10, if the engine speed is not below a predetermined speed "X", then the routine moves to decision block P12 where the fuel temperature is compared to a predetermined value "Y". If the fuel temperature is greater than "Y", then the routine moves to operation bock P16 where the fuel pump speed is decreased. After the fuel pump speed is reduced, the routine repeats.

If in decision block P12 the fuel temperature is less than the predetermined value "Y", the routine moves to decision block P14. In the decision block P14 the fuel pressure is compared to a predetermined value "Z". If the fuel pressure is greater than a predetermined value "Z", then the routine moves to operation block P16, where the fuel pump speed is decreased. If in the decision block P14 the fuel pressure is less than a predetermined value "Z", than the routine returns. Preferably, the routine repeats substantially continuously during engine operation.

Although the flowchart of FIG. 3 illustrates the decision steps P10, P12, P14 being executed in a particular sequence, one skilled in the art will appreciate that the steps can be executed in any order. Furthermore, in particular embodiments, the steps may be executed concurrently such that the ECU 102 continuously monitors the three sensors 122, 124, 126 and responds when one or more of the sensors outputs a signal outside an acceptable range.

Circulating excess fuel has the advantage of cooling the fuel, however if the fuel is circulated too much then the circulation of the fuel can itself heat the fuel and the desired optimal fuel temperature range is not achieved. The fuel can also be heated through a high fuel pressure, which can also contribute to not achieving an optimal fuel temperature range.

In the preferred embodiment, the fuel temperature, the fuel pressure and the engine speed are closely monitored by the fuel temperature sensor 126, the fuel pressure sensor 124 and the engine speed sensor 122. The monitored parameters enable the fuel system to provide the fuel injectors with vaporless fuel, which increases engine performance, improves exhaust emissions, and provides accurate engine response and efficiency.

Thus, from the foregoing description it should be readily apparent that the described construction is very effective in providing good fuel flow to the engine and yet ensuring against excess fuel flow. Of course, the foregoing description is that of a preferred embodiment of the invention and various changes and modifications may be made without departing from the spirit and scope of the invention, as defined by the appended claims.

What is claimed is:

1. A fuel supply system for an internal combustion engine, the fuel supply system providing fuel to the internal combustion engine, the fuel supply system comprising a first fuel pump driven by an electric motor, a second fuel pump, a vapor separator disposed between the first and second fuel pumps, and an electronic control unit that controls the first electric motor to control the fuel flow through the first fuel pump to the vapor separator in response to engine speed, fuel temperature and fuel pressure.

2. The fuel supply system as set forth in claim 1, wherein the speed of the low pressure fuel pump is controlled by the electronic control unit dependent on engine speed, fuel pressure, and fuel temperature.

3. The fuel supply system as set forth in claim 2, wherein engine speed is determined using an engine speed sensor, the fuel temperature is determined using a fuel temperature sensor, and the fuel pressure is determined using a fuel pressure sensor.

4. The fuel supply system as set forth in claim 1, wherein a fuel pressure relief valve relieves fuel pressure from the pressure side of the low pressure fuel pump and delivers the fuel to the scavenge side of the low pressure fuel pump.

5. The fuel supply system as set forth in claim 4, wherein the fuel pressure is sensed by fuel pressure sensors and the fuel temperature is sensed by a fuel temperature sensor, the fuel pressure sensors and the fuel temperature sensor are located on the pressure side of the low pressure fuel pump and before the pressure relief valve circuit.

6. The fuel supply system as set forth in claim 1, wherein a plurality of fuel injectors are in communication with a high pressure fuel pump being supplied by the vapor separator and delivering vaporless fuel to at least one intake port or directly into at least one combustion chamber.

7. The fuel supply system as set forth in claim 1, wherein the internal combustion engine is a marine engine.

8. The fuel supply system as set forth in claim 7, wherein the marine engine provides power to a watercraft.

9. The fuel supply system as set forth in claim 7, wherein the marine engine is an outboard motor.

* * * * *